US007429206B2

(12) United States Patent
Perry

(10) Patent No.: US 7,429,206 B2
(45) Date of Patent: Sep. 30, 2008

(54) UPPER BODY UNDERGARMENT

(76) Inventor: Judith Perry, 44 Dalby St., Newton, MA (US) 02458

( * ) Notice: Subject to any disclaimer, the term of this patent is extended or adjusted under 35 U.S.C. 154(b) by 142 days.

(21) Appl. No.: 11/333,265

(22) Filed: Jan. 18, 2006

(65) Prior Publication Data

US 2007/0163026 A1 Jul. 19, 2007

(51) Int. Cl.
*A41C 3/00* (2006.01)
*A41D 27/13* (2006.01)

(52) U.S. Cl. ..... 450/86; 450/1; 2/54; 2/59; 2/109

(58) Field of Classification Search ..... 450/1, 450/86, 88; 2/59, 54, 56, 105, 106, 109, 2/113, 115, 69, 67, 271
See application file for complete search history.

(56) References Cited

U.S. PATENT DOCUMENTS 2,264,972 A * 12/1941 Greenberg ..... 2/271
3,474,465 A * 10/1969 Artzt ..... 2/113
4,350,162 A 9/1982 Kearton et al.
4,625,338 A * 12/1986 Starling ..... 2/106
4,764,988 A * 8/1988 Reaver ..... 2/268
5,038,414 A * 8/1991 Freeman ..... 2/409
5,097,537 A 3/1992 Ewing
D331,138 S 11/1992 Kopp et al.
5,431,030 A * 7/1995 Ishizaki et al. ..... 66/176
5,667,422 A 9/1997 Erwin
6,000,993 A 12/1999 Erwin
6,113,460 A 9/2000 McKeown
6,183,339 B1 2/2001 Thompson
6,393,611 B1 5/2002 Thompson

OTHER PUBLICATIONS www.comtemporarydesigninc.com/bras.htm; CDI Bras & Breast Support; Jul. 14, 2005.

* cited by examiner

*Primary Examiner*—Gloria Hale

(57) ABSTRACT

Ladies garment designed to be worn under a brassiere for the purpose of supporting and lifting the breasts and smoothing the appearance of the upper torso and arms, without interfering with the appearance of the brassiere under outerwear. The garment, made primarily from hosiery material, includes tapered sides fastening in front between the breasts with adjustable, releasable fasteners providing adjustable support and lift, and having sub-pectoral support portions disposed in the tapered sides and covering and supporting the lower lateral and bottom portions of the breasts and the sub-pectorals. Garment may additionally include: support portions on the underside of the sleeves at the triceps; and armpit panels made from breathable or moisture-wicking fabric allowing for ventilation and moisture-wicking. To minimize slippage and displacement, the garment is secured to the brassiere straps by cloth strips attached at the shoulder area of the garment.

18 Claims, 4 Drawing Sheets

UPPER BODY UNDERGARMENT

BACKGROUND OF THE INVENTION

1. Field of the Invention

The present invention relates to women's undergarments, and particularly to an upper body undergarment for supporting the breasts, arms and upper torso.

2. Description of the Related Art

Pantyhose has been used for years by women trying to create a smoother, sleeker line along their legs. Excess cellulite or other unattractive features of the legs may be hidden by the smooth look that pantyhose exudes. While this smooth line has been used primarily along legs and hips, some undergarments and outer garments made of various materials have been used for the upper body for similar purposes. Many women of all ages have lost muscle tone in the upper torso, arms, underarms, triceps, back and breasts due to weight loss, excessive weight gain and, in many older women, due to aging. Many women desire the appearance of slimmer, smoother arms and upper torso regions, cover up of other unattractive features on the skin, as well as added support and lift for the breasts.

Generally, girdles or other types of undergarments have been used to shape the torso and a full girdle includes a bra for supporting the breasts. Girdles, however, are quite uncomfortable and are generally quite bulky. Other similar garments may be too large and cumbersome to be easily worn underneath clothing, including underneath brassieres.

Some garments only support the breasts, while others cover the breasts and arms. For example, U.S. Pat. No. 6,393,611 describes a garment that covers the breasts and conceals the arms and is worn over a conventional brassiere. Modern brassieres, however, are often made for a specific look under outerwear. A very smooth outer cup surface on a brassiere is often worn under thin t-shirts, knits and other close-fitting materials. Decorative brassieres are often worn underneath sheer fabrics. Use of the garment of U.S. Pat. No. 6,393,611 with these brassieres would detract from the aesthetic value of these types of brassieres.

Other garments only surround the arms and upper torso of the wearer. An example of such a garment is the compression arm sleeve bolero shown on a web page published on the Internet at least as of Jul. 14, 2005 by Contemporary Design, Inc. at www.contemporarydesigninc.com/bras.htm, which shows a jacket that provides upper back compression and support for the arms. Compression garments, typically worn after surgery (liposuction, breast enhancement, etc.) to improve blood circulation and help with healing, are available for compressing many areas of the body.

There is a need for an upper body undergarment for more practical everyday use that provides adjustable under-bra support and lift for the breasts, does not interfere with the look of the conventional brassiere underneath clothing, constricts the "flabbiness" around the arms, back and upper torso and is made from material thin enough to be comfortably worn underneath a brassiere and outer clothing. A garment that is not bulky will enhance the look of the wearer's arms and upper torso under sheer fabrics, close-fitting knits and materials that can undesirably accentuate the appearance of fatness, loose flesh, or otherwise untoned areas. Added support and lifting of the breasts will also contribute to an attractive shaping of the breasts and an often-desired appearance of fuller breasts under these fabrics. Worn under outerwear, a garment that offers underarm ventilation by means of "breathable" fabric in the armpit area will also add to the comfort of the wearer. Thus, an upper body undergarment solving the aforementioned problems is desired.

SUMMARY OF THE INVENTION

The upper body undergarment is designed to provide a range of support functions to a user's upper body. The upper body undergarment is particularly constructed to provide support and lift to a woman's breasts, compression to the upper torso and arms, and support for the triceps and sub-pectorals. The term "sub-pectorals", for the purpose of this patent application, is meant to refer to that area just below the pectoral muscles on an erect woman. The upper body undergarment may be made as a continuous piece of hosiery material, or alternatively may include several pieces of material sewn together. The material or combination of materials used to make the garment is chosen from materials used in the manufacture of hosiery. These materials include, but are not limited to, nylon, polyester, acrylic, cotton, spandex, silk, LYCRA® spandex, ELASTANE® spandex, or similar fabrics. The hosiery material is generally of a fineness of no greater than 80-denier filament in order to be able to fit underneath the brassiere and outerwear. A denier is defined as a unit of fineness for yarn equal to the fineness of a yarn weighing one gram for each 9000 meters. The hosiery material is sheer so as to render it less obvious under sheer outerwear and may be tinted in various shades to blend in with the wearer's skin tone or colored to blend in with outerwear. The material used to make the undergarment may include synthetic moisture-wicking material for added comfort of the wearer.

The upper body undergarment has a front portion, a back portion, and a pair of arm sections connected to the front and back portions. The arm sections each have a shoulder portion and a sleeve integrally connected to the shoulder portion. The sleeves may have varying lengths. They may extend from the outer edges of the shoulders to the areas above the elbow, below the elbow or at the wrists of the user. The sleeves provide a comfortable range of support and proportionate fit for the wearer. The front portion has first and second tapered sides that support and cover the lower portions of the user's breasts, lifting the breasts. Adjustable, releasable, mating fasteners attach the first and second tapered sides to one another.

Each of the tapered sides has a sub-pectoral support portion designed to provide support and to lift up the breasts. The sub-pectoral support portions may be stitched along the lower rim, be made of heavier weight spandex and/or higher denier yarns, or may alternatively comprise an additional layer of material that is affixed to the tapered sides. The upper body undergarment may also include optional underarm support portions at the triceps area on the sleeves that are similar to the sub-pectoral support portions in that they may be made of heavier weight spandex and/or higher denier yarns, or comprise an additional layer of material affixed to the sleeves.

The upper body undergarment includes means for retaining bra straps. The first embodiment of the means comprises very small bands or strips of material attached to the undergarment where the front portion and back portion meet atop the shoulders of the wearer. These small strips of cloth measure approximately ¾ inch by ¼. Both ends of the strips are sewn, or affixed in any suitable manner (tape, etc.), to the undergarment while leaving a gap or channel in the middle of the strips to allow room for the bra straps to be threaded through or placed underneath. A second, and preferred embodiment, comprises longer strips of cloth approximately 1½ inch by ¼ inch that are folded once over to form folded strips of cloth measuring approximately ¾ inch by ¼ inch. The folded end of each of the strips is sewn to the undergarment, or affixed in any manner suitable, where the front portion and back portion meet atop the shoulders of the wearer. The bottom half of each the strips are also sewn to the undergarment, or affixed in any manner suitable, where the front portion and back portion meet atop the shoulders of the wearer. One part of a connecting device (snap, hook, VELCRO® hook and loop fastener, tape, zip tie, or similar device) is attached to the bottom half of each of the strips at the open end, and the mating piece of the connecting device is attached to the top half of each of the strips at the open, free end, allowing the two pieces (top and bottom) to be snapped, hooked, etc. while leaving a gap or channel in the middle. This allows for the bra straps to be placed in between the doubled-over strips and secured in place when the top and bottom of the strips are snapped, hooked, or otherwise attached together.

Optional armpit panels made from natural, breathable fabric such as cotton (similar to the crotch area in typical pantyhose) or man-made breathable and/or moisture-wicking fabric are attached on the underside of the arm sections between the shoulder portion and the sleeve at the armpit area. The armpit panels allow for ventilation into the armpit area of the individual wearing the undergarment.

The upper body undergarment is preferably made from a continuous, seamless piece of hosiery material. Alternatively, the undergarment can be constructed of several pieces of hosiery material that are cut and sewn together for even more versatility and customized sizing of the arm and breast portions.

These and other features of the present invention will become readily apparent upon further review of the following specifications and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
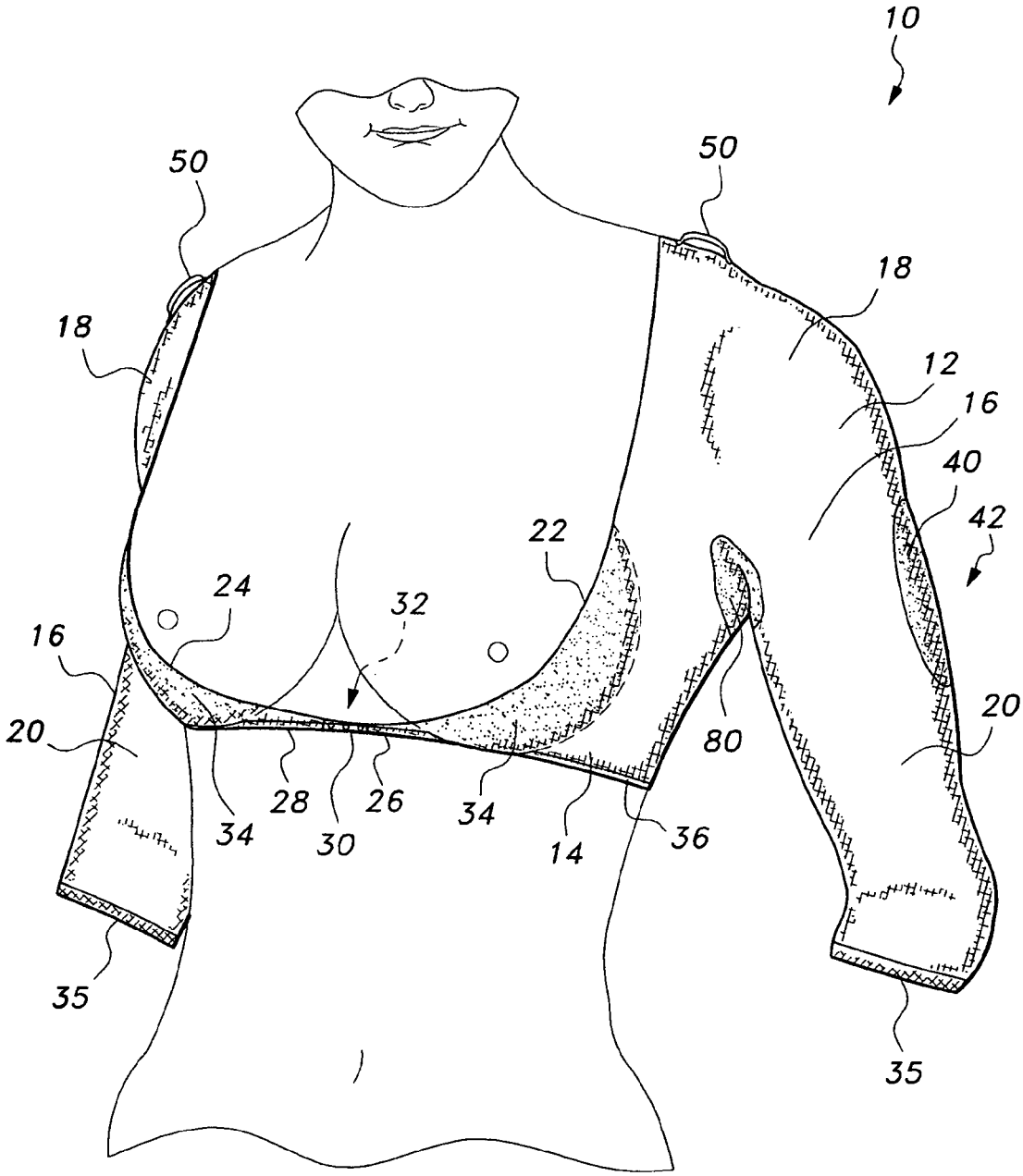
FIG. 1 is an environmental, perspective view of a first embodiment of an upper body undergarment according to the present invention.

The present invention is an upper body undergarment, which is designed to provide support and compression to a user's upper body. The upper body undergarment, designated as 10, 10*a* and 10*b* in the drawings, is particularly constructed to support and lift a woman's breasts and support and compress the arms and loose portions of the upper torso.

Referring first to FIG. 1, the upper body undergarment 10 is made from hosiery material 12. The hosiery material 12 may be made from any type or combination of hosiery material, including, but not limited to, nylon, polyester, acrylic, cotton, silk, spandex, LYCRA® spandex, ELASTANE® spandex, or similar fabrics. The hosiery material 12 is generally of a fineness of no greater than 80-denier filament. The definition of denier as here defined is a unit of fineness for rayon, nylon, silk, etc. fibers, based on a standard mass per length of 1 gram per 9,000 meters of yarn. This distinction of the fineness is due to the nature of the upper body undergarment 10. As the undergarment 10 is designed to fit underneath outer clothing and brassieres, the material 12 cannot be excessively thick.

The upper body undergarment 10 has a front portion 14 and a pair of arm sections 16. The arm sections 16 each have a shoulder portion 18 and a sleeve 20 integrally connected to the shoulder portion 18. When worn by a user, the shoulder portion 18 partially covers the shoulder of a user. The sleeve 20 extends downward from the shoulder portion 18 and in this embodiment the sleeve 20 extends just below the elbow.

The front portion 14 is integrally connected with the arm sections 16 at the shoulder portions 18. The front portion 14 has a first tapered side 22 and a second tapered side 24 that support and cover a portion of the user's breasts. The tapered sides 22 and 24 are designed to support and lift the breasts as the tapered sides 22 and 24 cover the lower portions of each of the breasts. The first tapered side 22 has an end portion 26 and the second tapered side 24 has an end portion 28. The tapered sides 22 and 24 are connected by overlapping end portions 26 and 28 as shown at area 32 located at the front center of the undergarment. The end portions 26 and 28 include adjustable, releasable fasteners 30 so that the garment 10 is releasably fastened in front between the breasts. Releasable fasteners 30 are chosen from the group including, but not limited to, snaps, hook and eye fasteners, VELCRO® hook and loop fastener, tape, zip ties or similar devices.

The tapered sides 22 and 24 do not comprise a full cup for covering the entire breast. Rather, each of the tapered sides 22 and 24 has a sub-pectoral support portion 34. The sub-pectoral support portions 34 are designed to provide support and lift to the breast. When the undergarment 10 is worn, the sub-pectoral support portions 34 support the lower lateral and bottom portion of the breasts in order to provide support and lift, while the nipples, the upper portions, and the lower medial portions of the breasts are left uncovered by the undergarment. The tapered sides 22 and 24 define a scalloped or scooped front face of the undergarment 10 that leaves most of the breasts exposed. The sub-pectoral support portions 34 may be integrated with the hosiery material 12 and may have stitching along the lower rim, and/or have a higher level of firmness when made from higher denier yarns and/or heavier weight spandex than the material of the remainder of the front portion 14 of the undergarment 10. The sub-pectoral support portions 34 may alternatively comprise an additional layer of material that is affixed to the tapered sides 22 and 24 at the sub-pectoral support portions 34 of the undergarment 10. The sub-pectoral support portions 34 may be made from any type or combination of hosiery material including, but not limited to, nylon, polyester, acrylic, cotton, silk, spandex, LYCRA® spandex, ELASTANE® spandex, or similar fabrics including moisture-wicking fabric. The bottom edges of the sleeves 35 and the bottom of the torso area 36 have extra elasticity all around for a more secure fit.

The upper body undergarment 10 may also include optional underarm support portions 40 of the sleeves 20 that are similar in composition to the sub-pectoral support portions 34 described above. The underarm support portions 40 bear against the underside 42 of a user's arm (in the triceps area) when the undergarment 10 is worn. The underarm support portions 40 are designed to more greatly restrict the areas underneath the arm of a user. The underarm support portions 40 may be integrated with the hosiery material 12 and may have a higher level of firmness than the hosiery material 12, when made from higher denier yarns and/or heavier weight spandex than the material of the remainder of the arm sections. Alternatively, the underarm support portions 40 may comprise additional material or a double layer of material that is affixed to the sleeves 20.

When a brassiere is placed over the undergarment 10, the upper body undergarment 10 is secured to brassiere straps by very small strips of material 50. The details of strips 50 and their operation are discussed below with respect to FIGS. 3A and 3B.

Optional armpit panels 80 are attached on the underside of the arm sections 16 between the shoulder portion 18 and the sleeve 20 at the armpit area of the wearer. The armpit panels 80 are similar to the ventilated crotch area typical of pantyhose. The armpit panels 80 are composed of natural, breathable fabric such as cotton or man-made breathable and/or moisture-wicking materials. The armpit panels 80 are sewn into the area under the arms at the armpit between the shoulder portion 18 and the sleeve 20. The armpit panels 80 allow for ventilation of the armpit area of the individual.

Figure 2:
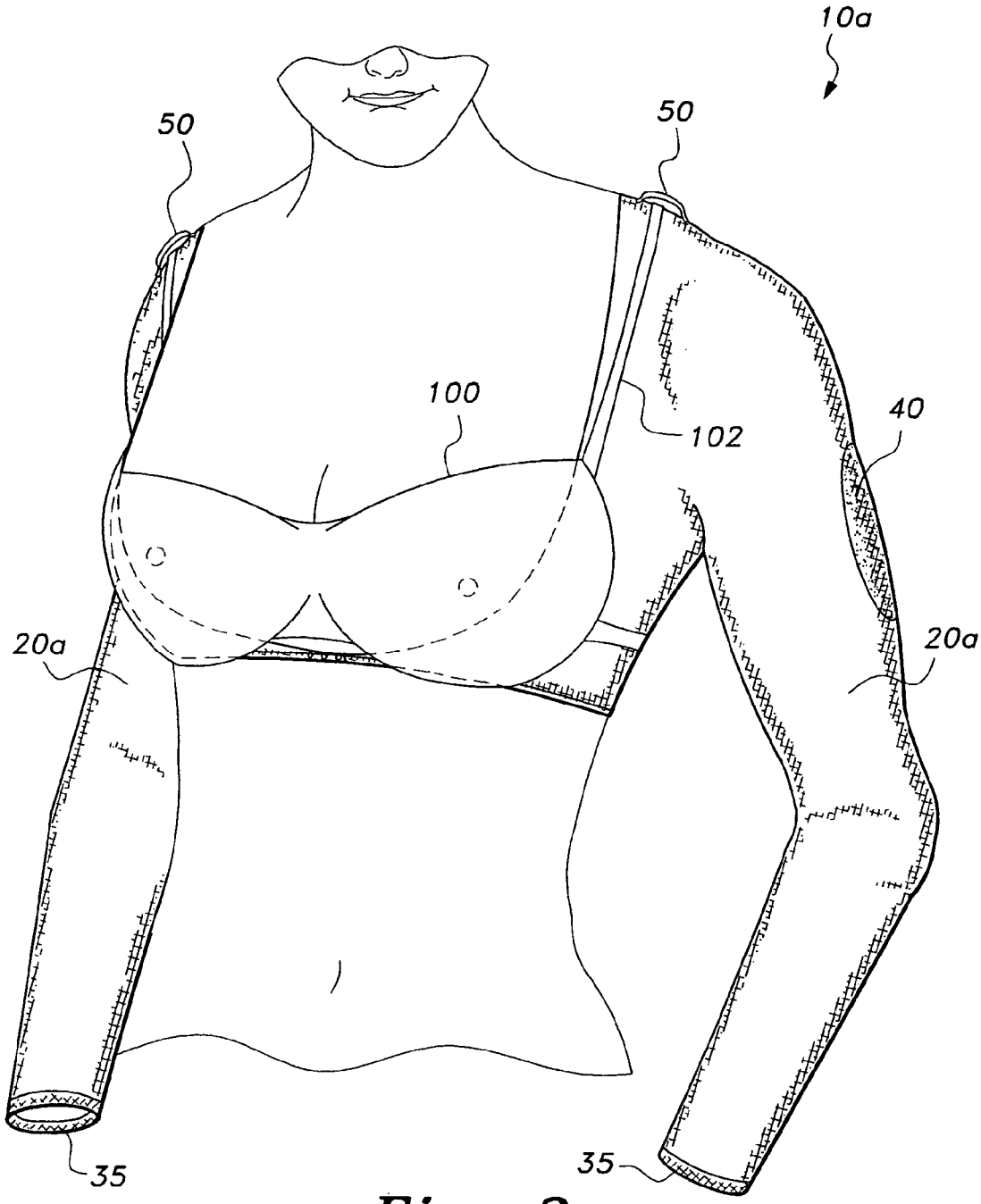
FIG. 2 is an environmental, perspective view of a second embodiment of the upper body undergarment according to the present invention with a brassiere worn over the undergarment.

Turning now to FIG. 2, a second embodiment of the upper body undergarment 10*a* is shown being worn under a brassiere 100. The second embodiment of the upper body undergarment 10*a* differs from the first embodiment 10, in that the sleeves 20*a* of the second embodiment extend to the wrists of the user. The brassiere 100 is worn over the undergarment 10*a*. The undergarment 10*a* is secured to the brassiere straps 102 by means of strips 50 as described in detail below.

Figure 3A:
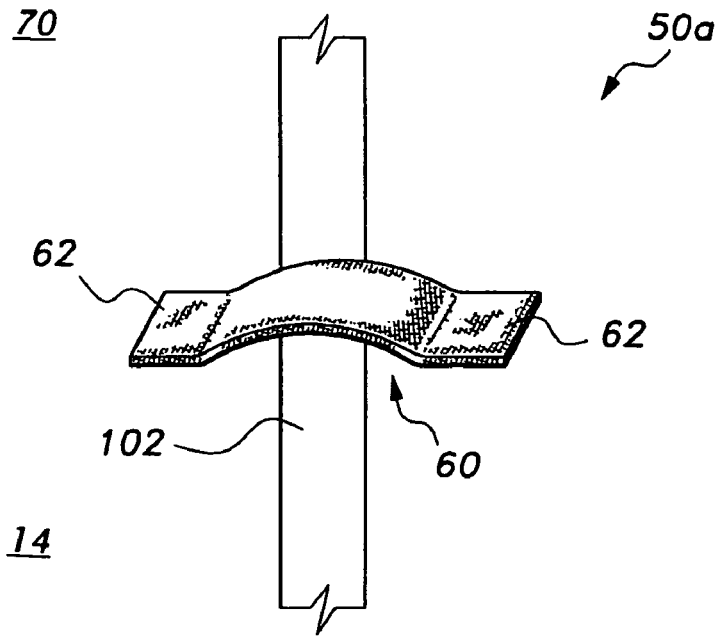
FIG. 3A is a magnified view of a first embodiment of strips for securing the undergarment to brassiere straps.

Turning to FIG. 3A, a first embodiment 50*a* of the aforementioned cloth strips 50 is shown. When a brassiere is placed over the undergarment, the upper body undergarment is secured to brassiere straps by means of very small fabric strips 50*a* that are attached to the garment where the front portion 14 meets the back portion 70 atop the shoulders of the wearer. These strips of cloth 50*a* measure approximately ¾ inch by ¼ inch. The small strips of cloth 50*a* are sewn, or affixed in any manner suitable (tape, etc.), at both ends 62 thus attaching them to the undergarment while leaving a gap or channel 60 in the middle that allows for the bra straps 102 to be threaded through or placed underneath. Securing the undergarment to a brassiere in this manner helps to minimize slippage and displacement of the undergarment. The strips of cloth 50*a* can be made from any type or combination of material used in the manufacture of hosiery including, but not limited to, nylon, polyester, acrylic, cotton, silk, spandex, LYCRA® spandex, ELASTANE® spandex, or similar fabrics.

Figure 3B:
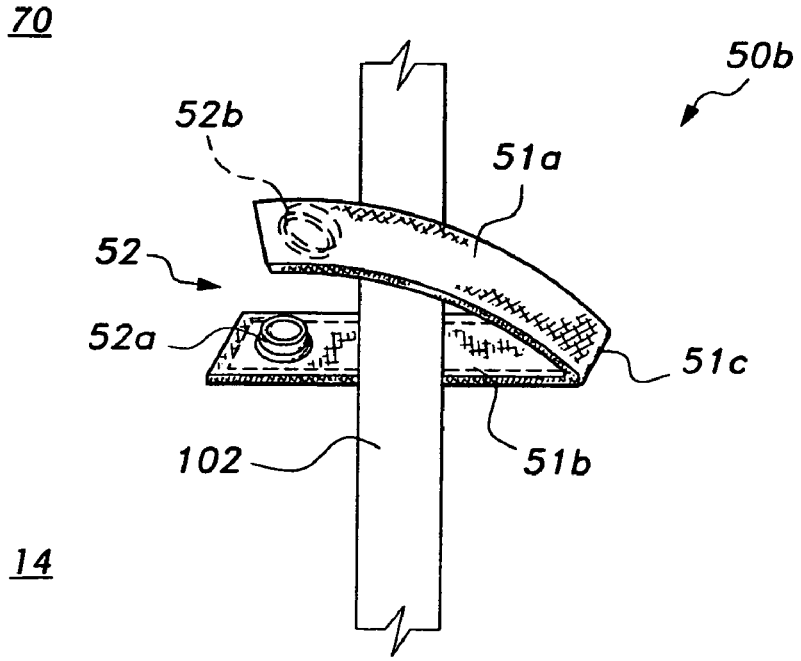
FIG. 3B is a magnified view of a second embodiment of strips for securing the undergarment to brassiere straps.

Turning now to FIG. 3B, a second, preferred embodiment 50*b* of the aforementioned cloth strips 50 is shown. When a brassiere is placed over the undergarment, the upper body undergarment is secured to brassiere straps 102 by means of longer strips of cloth measuring approximately 1½ inches by ¼ inch that are folded over once, forming two ¾ inch by ¼ folded strips of cloth. The strips thus formed include a top portion 51*a* and a bottom portion 51*b* connected by the fold 51*c*. The folded ends 51*c* are sewn, or attached in any suitable manner, to the undergarment where the front portion 14 meets the back portion 70 atop the shoulders of the wearer. Likewise, the bottom portion 51*b* of the strips 50*b* are also sewn, or attached in any suitable manner, to the undergarment where the front portion 14 meets the back portion 70 atop the shoulders of the wearer. The top portions 51*a* of the strips 50*b* are sewn or attached only at the folded ends 51*c*, as described above. A connecting device (indicated generally as 52) is used to connect the open ends of the strip portions 51*a* and 51*b*. A first piece 52*a* of the connecting device 52 (which can include but is not limited to: snaps, clasps, hook and eye fasteners, magnets, VELCRO® hook and loop fastener, tape or zip ties) is attached to the open end of the bottom portions 51*b* of the strips 50*b*. A second mating piece 52*b* of the connecting device 52 is attached to the open end of the top portions 51*a* of the strips 50*b*, allowing the two pieces 52*a* and 52*b* of the connecting device to be mated thereby attaching the open ends of strip portions 51*a* and 51*b*, while leaving a gap or channel between the top and bottom portions 51*a* and 51*b*. Before connecting the top and bottom pieces 52*a* and 52*b*, the brassiere straps 102 are placed between the top and bottom strip portions 51*a* and 51*b*. The connecting device 52 then closes and secures the open ends of the top and bottom strip portions 51*a* and 51*b*. It should be noted that strips 50*a* or 50*b* can be used with any of the three embodiments of FIGS. 1, 2 or 4, the differences between the embodiments only being the length of the sleeves.

The undergarment of the present invention is designed to be worn under a brassiere 100 and the brassiere straps 102 are placed underneath, between or through the strips 50 as described above. This secures the undergarment to the brassiere straps 102, holding the top shoulder portions of the undergarment in place. Slippage and displacement of the undergarment are minimized by the strips 50 in conjunction with the brassiere straps 102 and also by virtue of the undergarment being worn underneath the brassiere 100.

Figure 4:
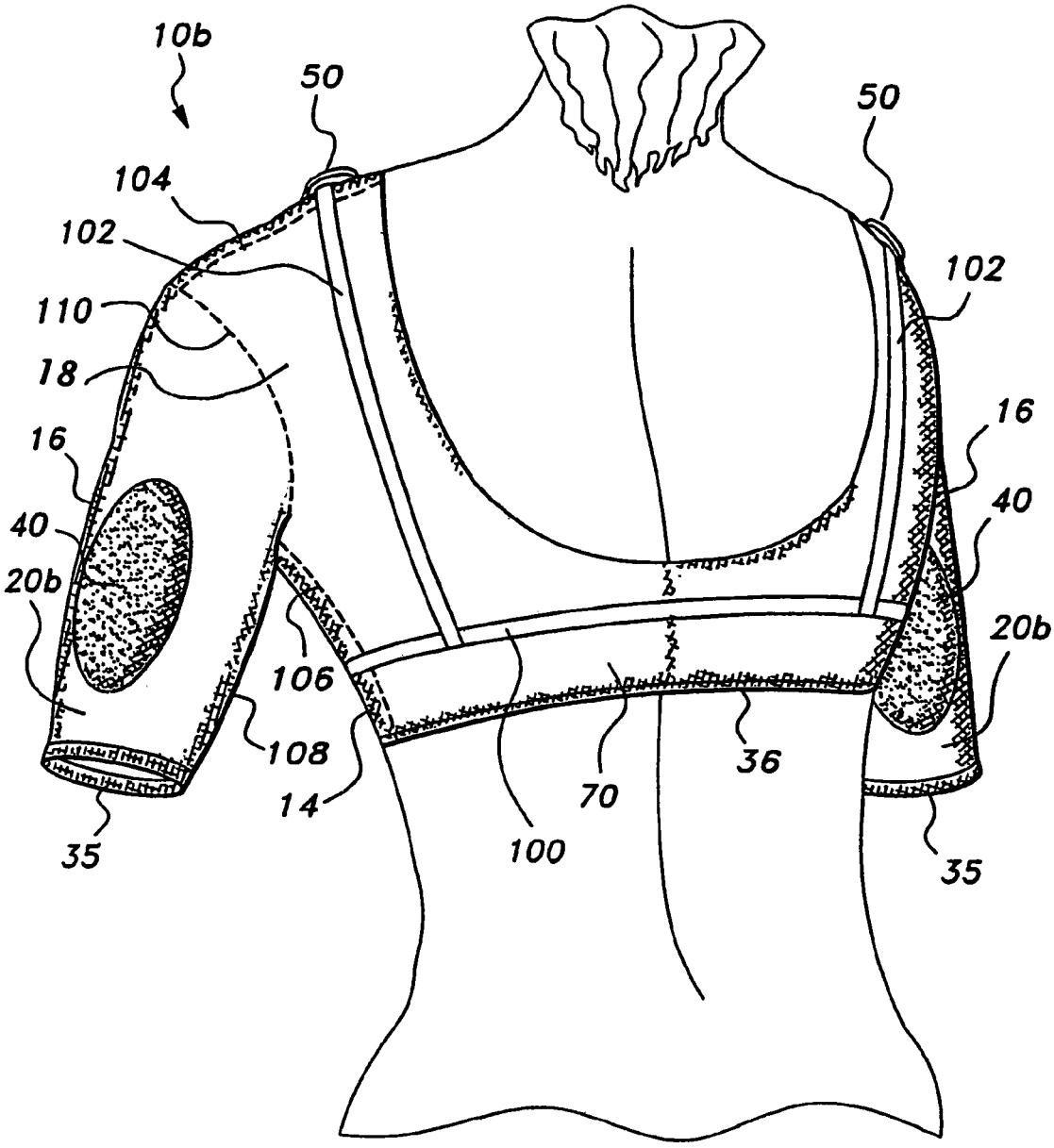
FIG. 4 is an environmental, perspective view of a third embodiment of an upper body undergarment according to the present invention as seen from behind with a brassiere worn over the undergarment.

FIG. 4 shows a back view of a third embodiment 10*b* of the upper body undergarment of the present invention. The third embodiment 10*b* is similar to the first 10 and second 10*a* embodiments of the undergarment, differing only in that the sleeves 20*b* of the third embodiment 10*b* terminate just above the elbow. FIG. 4 otherwise shows back features for all three embodiments. The back portion 70 of the upper body undergarment is connected to the front portion 14, and the arm sections 16 at the shoulder portions 18. The back portion 70 covers a portion of the back of a wearer.

Also shown in FIG. 4 are the seams 104, 106, 108 and 110 used in the non-continuous embodiment of the upper body undergarment 10*b*. The seams 104, 106, 108 and 110 are located in much the same location as most shirts. That is, a seam 104 extends between the back portion 70 and the front portion 14 and divides the shoulder portion 18 along the top of each of the wearer's shoulders. Another seam 106 extends between the back portion 70 and the front portion 14, beginning just under the arms of the wearer and continuing down the sides. A third seam 110 connects the sleeves 20*b* to the shoulder portions 18 in a circular fashion. A fourth seam 108 splits the sleeves 20*b* from the underarm along the underside of the sleeve to the end 35 thereof.

It should be noted that the preferred embodiment of all three embodiments (FIG. 1, FIG. 2 and FIG. 4) of the upper body undergarment of the present invention is made from a continuous piece of hosiery material. Any or all of the seams described above can be used with any of the three embodiments of the upper body undergarment to allow more versatility and customized sizing of the arm and breast portions. The thinness of the material, the partial covering of the breasts with sub-pectoral support, and the strips 50, are arranged and configured, as described above, to enable the upper body undergarment to be worn under a brassiere. This allows additional support to the breasts, arms and upper torso, without interfering with the specific desired appearance of the brassiere under outerwear.

It is to be understood that the present invention is not limited to the embodiments described above, but encompasses any and all embodiments within the scope of the following claims.

I claim:

1. An upper body undergarment for use under a brassiere, said upper body undergarment being constructed primarily of hosiery material and comprising:

a front portion extending from the shoulders to the area just below the pectoral muscles of the wearer, covering and supporting the sub-pectorals and lower lateral and bottom portions of the breasts, and having a first tapered side, a second tapered side; the tape red sides being connected to each other by overlapping end portions at the front center portion of the undergarment between the breasts;

a back portion connected to the front portion extending from the shoulders and covering a portion of the back at the upper torso of the wearer; and a pair of arm sections each having a shoulder portion connected to the front and back portions and a sleeve connected to the shoulder portion; wherein the first and second tapered sides provide support and lift for the breasts without interfering with a specific desired appearance of the brassiere worn thereover the upper body undergarment.

2. The upper body undergarment according to claim 1, wherein the overlapping end portions comprise adjustable releasable fasteners, so that the undergarment is adjustably fastened and released in front between the breasts.

3. The upper body undergarment according to claim 1, wherein each of the tapered sides further comprise a sub-pectoral support portion that extends from a wearer's lateral breast area to the overlapping end at the front center portion of the undergarment between the breasts thereby providing covering and additional support for the area just below the pectoral muscles on an erect woman and lower lateral and bottom portions of the breasts.

4. The upper body undergarment according to claim 3, wherein the sub-pectoral support portions comprise hosiery material containing heavier weight spandex than the hosiery material of the remainder of the front portion of the upper body undergarment.

5. The upper body undergarment according to claim 3 wherein the sub-pectoral support portions comprise an additional layer of material affixed to the tapered sides.

6. The upper body undergarment according to claim 1, further comprising means for securing the upper body undergarment to the brassiere straps at the shoulder areas minimizing slippage and displacement of the undergarment.

7. The upper body undergarment according to claim 6, wherein the means for securing the upper body undergarment to the brassiere straps comprises cloth strips sewn at both ends and attached to the shoulder areas, the cloth strips defining channels adapted for receiving the bra straps.

8. The upper body undergarment according to claim 6, wherein the means for securing the upper body undergarment to the brassiere straps comprises cloth strips attached to the shoulder areas having a top portion with an open end, and a bottom portion with an open end, the top and bottom portions being connected by a fold opposite the open ends, and wherein the bottom portions are attached to the upper body undergarment at both the open and folded ends, the top portions are attached only at the folded ends and a connecting device is used to connect the top and bottom portions to each other at the open ends thereby forming channels for the brassiere straps.

9. The upper body undergarment according to claim 1, further comprising underarm support portions on the underside of the sleeves at the triceps thereby providing additional support.

10. The upper body undergarment according to claim 9, wherein the underarm support portions comprise, hosiery material containing heavier weight spandex than the hosiery material of the remainder of the arm portions of the upper body undergarment.

11. The upper body undergarment according to claim 9, wherein the underarm support portions comprise an additional layer of material affixed to the sleeves.

12. The upper body undergarment according to claim 1, further comprising armpit panels disposed between each of the sleeves and each of the shoulder portions, the armpit panels being made from any one of breathable cotton fabric and synthetic moisture-wicking fabric allowing for greater ventilation and comfort to the wearer.

13. The upper body undergarment according to claim 1, further comprising armpit panels disposed between each of the sleeves and each of the shoulder portions, the armpit panels being made from synthetic moisture-wicking fabric.

14. The upper body undergarment according to claim 3, wherein the sub-pectoral support portions comprise synthetic moisture-wicking fabric to allow for greater ventilation and comfort to the wearer through the process of moisture-wicking.

15. The upper body undergarment according to claim 3, wherein the sub-pectoral support portions comprise hosiery material having higher denier yarns.

16. The upper body undergarment according to claim 5, wherein the additional layer of material comprises synthetic moisture wicking fabric.

17. The upper body undergarment according to claim 9, wherein the underarm support portions comprise hosiery material having higher denier yarns.

18. The upper body undergarment according to claim 11, wherein the additional layer of material is composed of moisture wicking fabric.

* * * * *